US007082633B1

(12) United States Patent
Maarbjerg

(10) Patent No.: US 7,082,633 B1
(45) Date of Patent: Aug. 1, 2006

(54) PILLOW

(75) Inventor: Kirsten Maarbjerg, Odense (DK)

(73) Assignee: Tempur World, LLC, Lexington, KY (US)

( * ) Notice: Subject to any disclaimer, the term of this patent is extended or adjusted under 35 U.S.C. 154(b) by 0 days.

(21) Appl. No.: 11/051,555

(22) Filed: Feb. 4, 2005

(51) Int. Cl.
*A47G 9/00* (2006.01)

(52) U.S. Cl. ..... 5/636; 5/644

(58) Field of Classification Search ..... 5/636, 5/644
See application file for complete search history.

(56) References Cited

U.S. PATENT DOCUMENTS

| | | | | |
|---|---|---|---|---|
| 1,382,831 | A | 6/1921 | Hiker | |
| 2,167,622 | A * | 8/1939 | Bentivoglio | 5/636 |
| 2,295,906 | A | 9/1942 | Lacour | |
| 2,298,218 | A | 10/1942 | Madson | |
| 2,552,476 | A | 5/1951 | Barton | |
| 2,898,975 | A | 8/1959 | Wagner | |
| 3,148,389 | A | 9/1964 | Lustig | |
| 3,327,330 | A | 6/1967 | McCullough | |
| 3,400,413 | A | 9/1968 | La Grossa | |
| 3,829,917 | A | 8/1974 | De Laittre et al. | |
| 4,118,813 | A * | 10/1978 | Armstrong | 5/638 |
| 4,218,792 | A * | 8/1980 | Kogan | 5/636 |
| D259,381 | S | 6/1981 | Smith | |
| D282,427 | S | 2/1986 | O'Sullivan | |
| D284,724 | S | 7/1986 | Clark et al. | |
| 4,773,107 | A | 9/1988 | Josefek | |
| 4,773,142 | A | 9/1988 | Davis et al. | |
| D298,198 | S | 10/1988 | O'Sullivan | |
| 4,788,728 | A | 12/1988 | Lake | |
| 4,799,275 | A | 1/1989 | Sprague | |
| 4,832,007 | A | 5/1989 | Davis, Jr. et al. | |
| 4,862,539 | A | 9/1989 | Bokich | |
| D303,897 | S | 10/1989 | Phillips | |
| D305,084 | S | 12/1989 | Gyebnar | |
| 4,908,893 | A | 3/1990 | Smit | |
| 5,018,231 | A | 5/1991 | Wang | |
| D320,715 | S | 10/1991 | Magnin et al. | |
| 5,054,143 | A | 10/1991 | Javaher | |
| 5,088,141 | A | 2/1992 | Meyer et al. | |
| D325,839 | S | 5/1992 | Main | |
| 5,138,732 | A | 8/1992 | Wattie et al. | |
| D333,938 | S | 3/1993 | Watson et al. | |
| D334,318 | S | 3/1993 | Chee | |

(Continued)

FOREIGN PATENT DOCUMENTS

| | | |
|---|---|---|
| GB | 1273259 | 5/1972 |

OTHER PUBLICATIONS

Picture of Brookstone Tempur-Pedic Pillow, available prior to Feb. 4, 2005.

(Continued)

*Primary Examiner*—Michael Trettel
(74) *Attorney, Agent, or Firm*—Michael Best & Friedrich

(57) ABSTRACT

A pillow adapted for supporting the head of a user. In some embodiments, the pillow can have a visco-elastic body having a center portion elevated with respect to adjacent lateral side portions, each of which can have a recess. The recess can have a concave shape in both lateral and forward/rearward directions of the pillow, can extend and be open to the front and/or lateral sides of the pillow, and can be positioned and shaped to lie beneath the face of a user whose head is at least partially supported by the center portion of the body. Also, the center portion of the pillow can be separated from the laterally adjacent recesses by arcuate-shaped boundaries.

24 Claims, 8 Drawing Sheets

U.S. PATENT DOCUMENTS

| | | | |
|---|---|---|---|
| D336,809 | S | 6/1993 | Emery |
| 5,265,295 | A | 11/1993 | Sturgis |
| 5,367,731 | A | 11/1994 | O'Sullivan |
| D354,876 | S | 1/1995 | Pace |
| D359,870 | S | 7/1995 | McLaughlin |
| 5,437,070 | A | 8/1995 | Rempp |
| 5,457,832 | A | 10/1995 | Tatum |
| D367,390 | S | 2/1996 | Johnston et al. |
| 5,528,784 | A | 6/1996 | Painter |
| D381,855 | S | 8/1997 | Galick |
| D383,026 | S | 9/1997 | Torbik |
| D387,235 | S | 12/1997 | Carpenter |
| D388,648 | S | 1/1998 | Bates |
| D388,649 | S | 1/1998 | Chekuri |
| D388,650 | S | 1/1998 | Davis |
| 5,708,998 | A | 1/1998 | Torbik |
| D393,564 | S | 4/1998 | Liu |
| D395,568 | S | 6/1998 | Davis |
| 5,778,470 | A | 7/1998 | Haider |
| D399,675 | S | 10/1998 | Ferris |
| D402,150 | S | 12/1998 | Wurmbrand et al. |
| 5,848,448 | A | 12/1998 | Boyd |
| D404,237 | S | 1/1999 | Boyd |
| 5,884,351 | A | 3/1999 | Tonino |
| D410,810 | S | 6/1999 | Lozier |
| D412,259 | S | 7/1999 | Wilcox et al. |
| 5,926,880 | A | 7/1999 | Sramek |
| D415,920 | S | 11/1999 | Denney |
| D417,579 | S | 12/1999 | Tarquinio |
| 6,003,177 | A | 12/1999 | Ferris |
| D418,711 | S | 1/2000 | Mettler |
| D429,106 | S | 8/2000 | Bortolotto et al. |
| D434,936 | S | 12/2000 | May |
| 6,182,312 | B1 | 2/2001 | Walpin |
| 6,317,908 | B1 | 11/2001 | Walpin |
| 6,345,401 | B1 | 2/2002 | Frydman |
| D455,311 | S | 4/2002 | Fux |
| 6,408,467 | B1 | 6/2002 | Walpin |
| 6,412,127 | B1 | 7/2002 | Cuddy |
| 6,471,726 | B1 | 10/2002 | Wang |
| D474,364 | S | 5/2003 | Arcieri |
| 6,574,809 | B1 * | 6/2003 | Rathbun ..... 5/636 |
| 6,742,207 | B1 * | 6/2004 | Brown ..... 5/636 |
| 6,915,539 | B1 * | 7/2005 | Rathbun ..... 5/636 |
| 2001/0018777 | A1 | 9/2001 | Walpin |
| 2003/0188383 | A1 | 10/2003 | Ense |
| 2003/0188385 | A1 | 10/2003 | Rathbun |

OTHER PUBLICATIONS

Picture of Support II System Pillow, available prior to Feb. 4, 2005.

Picture of Isotonic Pillow, available prior to Feb. 4, 2005.

Picture of Advanced Comfort's Standard Pillow, available prior to Feb. 4, 2005.

Picture of Bay Jacobsen's Standard Pillow, available prior to Feb. 4, 2005.

Picture of Confur Plus Pillow, available prior to Feb. 4, 2005.

Picture of Dream Pillow, available prior to Feb. 4, 2005.

Picture of Supple Pedic Pillow, available prior to Feb. 4, 2005.

Website page printout of Pillow Park Plaza's Supple-Pedic Pillow, dated Jun. 27, 2000.

Website page printout of Carpenter Co.'s Isotonic Pillow, dated Jun. 27, 2000.

Website page printout of BackSaver's All Position Wonderform Pillow, dated Jun. 27, 2000.

Webiste page printouts of Bay Jacobsen's ViscoFlex, CombiFlex, Standard, Back Support and Anatomical sitting Wedge Pillows, dated Jun. 27, 2000.

Website page printout of Advanced Comfort's Swedish Contour Pillow, dated Jun. 27, 2000.

Website page printout of Strobel Technologies Supple-Pedic STandard, Travel, Extra Thick, Cervical Neck and Lumbar Back Pillows, dated Jun. 27, 2000.

Website printout of Power Products Inc.'s Splintek SleepRight Side Sleeping Pillow.

* cited by examiner

PILLOW

BACKGROUND OF THE INVENTION

Pillows are most commonly used for supporting the head of a user in a reclined, supine, or prone position. For example, pillows can be used when a person is lying on his or her side, back or front.

Demand continues to rise for pillows that are comfortable for a person sleeping in a variety of different positions. In addition, pillows that can comfortably support a range of different head sizes and shapes are welcome additions to the art.

SUMMARY OF THE INVENTION

Some embodiments of the present invention provide a pillow comprising a body of visco-elastic material comprising a width; a length greater than the width; a bottom side; a top side comprising first and second portions on opposite ends of the length of the pillow, wherein the first and second portions of the top side are separated by a center portion; and a recess in each of the first and second portions of the top side, each recess comprising a first cross-sectional shape in a direction along the length of the body and a second cross-sectional shape in a direction along the width of the body and perpendicular to the first cross-sectional shape, wherein each of the first and second cross-sectional shapes are substantially smooth and unfaceted.

In some embodiments, a pillow for supporting a head of a user is provided, and comprises a visco-elastic center portion elevated to support the head of the user; first and second laterally-disposed visco-elastic portions on opposite sides of the visco-elastic center portion, the first and second visco-elastic portions both recessed with respect to the visco-elastic center portion; a first plane passing through the visco-elastic center portion and substantially bisecting the pillow into substantially symmetrical lateral halves; and a second plane substantially perpendicular to the first plane and bisecting the pillow into asymmetrical front and rear halves; wherein a cross-sectional shape of the pillow generated by the second plane comprises a central plateau flanked by concave arcuate recesses extending toward opposite lateral sides of the pillow.

Some embodiments of the present invention provide a pillow for supporting a user's head having a back and a cheek, the pillow comprising a visco-elastic body comprising a periphery; a center portion; and first and second bowl-shaped recesses on opposite lateral sides of the center portion, each of the first and second bowl-shaped recesses at least partially open to the periphery of the visco-elastic body.

Further aspects of the present invention, together with the organization and operation thereof, will become apparent from the following detailed description of the invention when taken in conjunction with the accompanying drawings, wherein like elements have like numerals throughout the drawings.

Figure 1:
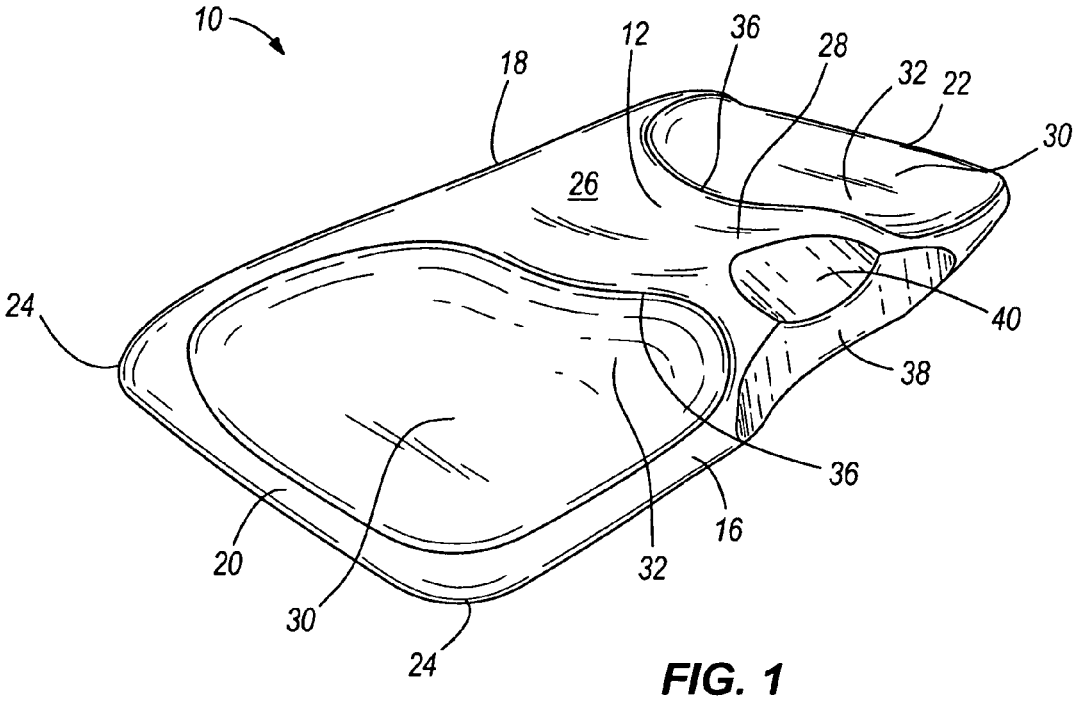
FIG. 1 is a front perspective view of a pillow according to an embodiment of the present invention.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", "left", "right", "lateral", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

A pillow according to an embodiment of the present invention is illustrated in FIGS. 1–9, and is indicated generally at 10. The pillow 10 is adapted to support the head of a user in a reclined, supine, or prone position, and can also support at least a portion of the neck of a user in some applications. The pillow 10 can be placed upon any surface for this purpose, including without limitation a mattress, floor, chair back, and the like.

In some embodiments, the pillow 10 has a generally rectangular shape, and can have a top side 12 upon which a user's head can rest, a bottom side 14 substantially facing a support surface upon which the pillow 10 can rest, a front side 16 substantially facing the body of a user whose head is upon the pillow 10, a rear side 18 opposite the front side 16, and lateral sides 20, 22 on opposite ends of the pillow 10.

The top side 12 and bottom side 14 define the overall thickness of the pillow 10, which can vary at different locations on the pillow 10. As best shown in FIGS. 2 and 3, the top and bottom sides 12, 14 of the pillow 10 can be generally rectangular in shape. In some embodiments, the corners 24 of the pillow 10 can be rounded (see FIGS. 1–7). Alternatively, the corners 24 can be substantially sharp, faceted, or can have any other shape desired. Although the top and bottom sides 12, 14 of the pillow 10 illustrated in FIGS. 1–9 are substantially rectangular, the top and bottom sides 12, 14 of the pillow 10 can have any other shape desired, including without limitation trapezoidal, triangular, and other polygonal shapes, round, oval, egg, and other rotund shapes, peanut, barbell, and other lobed shapes, irregular shapes, and the like. In those embodiments having substantially rectangular top and bottom sides 12, 14, the top and bottom sides 12, 14 can be square or can have elongated shapes. For example, the pillow 10 illustrated in FIGS. 1–9 is elongated, and has length and width dimensions similar to that of a conventional queen-size pillow. As another example, the pillow 110 illustrated in FIGS. 10–18 (and described below) has substantially rectangular top and bottom sides 112, 114, and has length and width dimensions similar to that of a conventional standard size pillow. Other types of common pillow sizes are possible (e.g., king-size pillows, continental or European continental square pillows, and the like), and fall within the spirit and scope of the present invention.

The front, rear, and lateral sides 16, 18, 20, 22 of the pillow 10 can have any shape or combination of shapes desired. For example, any or all of the front, rear, and lateral sides 16, 18, 20, 22 can be substantially flat and/or substantially perpendicular to a surface upon which the pillow 10 rests. As another example, any or all of the front, rear, and lateral sides 16, 18, 20, 22 can have a concave or convex profile, and can define curved transition surfaces with the top and/or bottom sides 12, 14 of the pillow 10. With reference to FIGS. 4–7 and 9 for example, the rear side 18 of the pillow 10 has a curved profile, meets with the top side 12 of the pillow 10 in a curved transition, and forms an angle with the bottom side 14 of the pillow 10. Also with reference to FIGS. 4–8, the lateral sides 20, 22 of the pillow 10 also have curved profiles, meeting with the top and bottom sides 12, 14 in curved transitions. Any other transitional shapes between the sides 12, 14, 16, 18, 20, 22 of the pillow 10 are possible, and fall within the spirit and scope of the present invention.

The pillow 10 can have a body 26 of deformable material or combination of deformable materials, including without limitation polyurethane or other types of foam, down, wool, husks, beads, and the like. However, in some embodiments, the body 26 includes visco-elastic foam. Temperature-sensitive visco-elastic foam can be used to provide increased adaptation to a user by virtue of the user's body heat, and can provide significantly improved user comfort in many cases. When compared to other types of foam, stuffing, and other cushion material, the visco-elastic foam of the body 26 can significantly improve pressure distribution of a user across the body 26. Such improved pressure distribution can reduce the opportunity for wrinkles and other blemishes to develop on the user, and can provide improved user support.

The body 26 can be constructed of a single integral piece of material, or can be constructed of two or more pieces of material coupled together by adhesive or cohesive bonding material, tape, hook-and-loop fastener material, or in any other manner. For example, the body 26 of the pillow 10 illustrated in FIGS. 1–9 is a single piece of visco-elastic foam. The body 26 can be formed in a number of different manners, such as by molding, casting, cutting or other types of machining, and the like, and in some embodiments is formed through a combination of such operations.

In some alternative embodiments, the body 26 can comprise a mass of granulated visco-elastic material retained within a cover (not shown) and having any of the pillow shapes described above. In such embodiments, the cover can comprise many different types of materials, including without limitation nylon, polyester, and other types of plastic, natural or synthetic rubber, cotton, wool, and any blend or other combination thereof. However, in some embodiments, a cover comprising visco-elastic material can provide additional benefits for the same reasons described above with reference to the visco-elastic material of the body 26 illustrated in FIGS. 1–9. Still other types of cover materials are possible, and fall within the spirit and scope of the present invention. The cover retaining the mass of granulated visco-elastic material can be vapor and/or liquid permeable or non-permeable, can be in any woven or non-woven form, and can be coated with any material desired. Also, in some embodiments different portions of such a cover can comprise different types or forms of material connected together in any suitable manner, such as by stitching, adhesive or cohesive bonding material, hook-and-loop fastener material, and the like.

In those embodiments in which the body 26 comprises a mass of granulated visco-elastic material retained within a cover as described above, the plurality of visco-elastic pieces can be generated by shredding or chopping visco-elastic material, and in some embodiments can have an average largest dimension of between 0.3 cm and 4 cm (although visco-elastic pieces having smaller or larger average sizes can be used, if desired).

Although any visco-elastic foam material can be used for the body 26 (whether in solid form or in granulated form as described above), in many cases, visco-elastic foam having certain material properties can provide improved performance results. In some embodiments, visco-elastic foam having a density of no less than about 40 $kg/m^3$ and/or no greater than about 110 $kg/m^3$ can provide good performance results. In other embodiments, visco-elastic foam having a density of no less than about 50 $kg/m^3$ and/or no greater than about 90 $kg/m^3$ can provide good performance results. In still other embodiments, visco-elastic foam having a density of no less than about 55 $kg/m^3$ and/or no greater than about 65 $kg/m^3$ can provide good performance results. For example, the body 26 of the pillow 10 can comprise visco-elastic foam having a density of about 60 $kg/m^3$.

Also, visco-elastic foam having a hardness of no less than about 30 N and/or no greater than about 80 N can provide good performance results. In other embodiments, visco-elastic foam having a hardness of no less than about 35 N and/or no greater than about 75 N can provide good performance results. In still other embodiments, visco-elastic foam having a hardness of no less than about 45 N and/or no greater than about 65 N can provide good performance results. For example, the body 26 of the pillow 10 can comprise visco-elastic foam having a hardness of about 55 N. In some cases, the body 26 can be constructed of reticulated visco-elastic foam to achieve desired cushion characteristics, such as an increased heat distribution capability and increased air circulation into and out of the body 26.

The body 26 illustrated in FIGS. 1–9 is contoured as will be described in greater detail below, and has substantially smooth surfaces. However, in other embodiments, any portion or portions of the body 26 can have surface features, such as dimpled or ribbed surfaces, surfaces with waves, bumps, or stippling, and the like.

With continued reference to the embodiment illustrated in FIGS. 1–9, the body 26 can have an center portion 28 elevated with respect to adjacent side portions 30. The center portion 28 can have an elevation suitable for supporting the head of a user in an elevated position (with respect to the surface upon which the pillow 10 rests). The center portion 28 can be substantially flat and planar, or can alternatively have a concave or convex shape. For example, the center portion 28 illustrated in the embodiment of FIGS. 1–9 has a slightly concave shape in a lateral direction and in a front-rear direction, thereby providing a slightly recessed location for receiving the rear portion of a user's head in a stable manner (whether the user is lying face up, face down, or on his or her side).

In addition, the center portion 28 of the body 26 can lie substantially in a plane parallel to the surface upon which the pillow 10 rests. For example, the center portion 28 can lie substantially in a horizontal plane when the pillow 10 rests upon a horizontal surface. In other embodiments, however, the center portion 28 can be sloped with respect to a surface upon which the pillow 10 rests. In the illustrated embodiment of FIGS. 1–9, for example, the center portion 28 is sloped toward the rear side 18 of the pillow 10.

In some embodiments, the center portion 28 has a rearward slope greater than about 0 degrees and/or less than about 50 degrees (measured by a straight object lying upon the center portion 28 and extending in a forward/rearward direction fully across the pillow 10). In other embodiments, the center portion 28 has a rearward slope greater than about 10 degrees and/or less than about 40 degrees. In the illustrated embodiment of FIGS. 1–9, the center portion 28 has a rearward slope of about 30 degrees.

As mentioned above, the center portion 28 of the body 26 can be elevated with respect to adjacent side portions 30. In this regard, both side portions 30 can define recesses 32 in the body 26. The recesses 32 can be positioned and shaped so that a user can rest a rear portion of his or her head upon the center portion 28 of the pillow 10 while the side and/or front of the user's face is elevated over the surface of either recess 32. Alternatively, the recess 32 can be positioned and shaped so that a user can rest a rear portion of his or her head upon the center portion 28 of the pillow 10 while at least a portion of the side and/or front of the user's face gently rests upon a surface of the recess 32. In either case, the weight of the user's head is carried entirely by the center portion 28, or is at least carried to a greater degree by the center portion 28 compared to conventional pillows 10. Accordingly, pressure upon the side and front of a user's face can be significantly reduced.

The recesses 32 can be concave in a lateral direction and/or in a forward/rearward direction. In some embodiments, recesses 32 that are concave in both lateral and forward/rearward directions can provide sufficient depth to accommodate a user's face while also providing smooth and unfaceted surfaces that could otherwise create lines or other blemishes on a user's face (if brought into contact therewith). The recesses 32 can be bowl-shaped, wherein the bowl shape can be symmetrical or asymmetrical, and wherein the bowl shape can have a rotund perimeter (see FIGS. 1 and 2) or can have a perimeter having any other shape desired.

In the illustrated embodiment of FIGS. 1–9, each recess 32 is concave in both lateral and forward/rearward directions, and has no seams, sharp angles, or facets. Therefore, in the event that a user's face comes into contact with or exerts pressure upon surfaces within either recess 32, the opportunity for lines or other blemishes to form upon the user's face is reduced. In addition, such a shape for the recesses 32 enables a user to remain comfortable even if the user's head has moved away from the center portion 28 toward either lateral side 20, 22 of the pillow 10, or has moved entirely within either recess 32. Despite such movement, the maintained comfort of the user in such positions can prevent the user from stirring or awakening.

Figure 8:
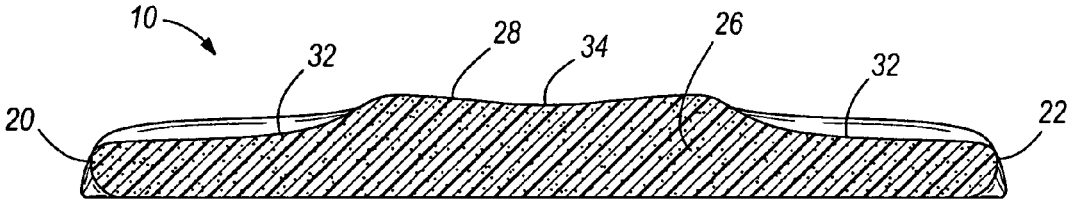
FIG. 8 is a cross-sectional view of the pillow illustrated in FIGS. 1–7, taken along lines 8—8 of FIG. 2.
Figure 9:
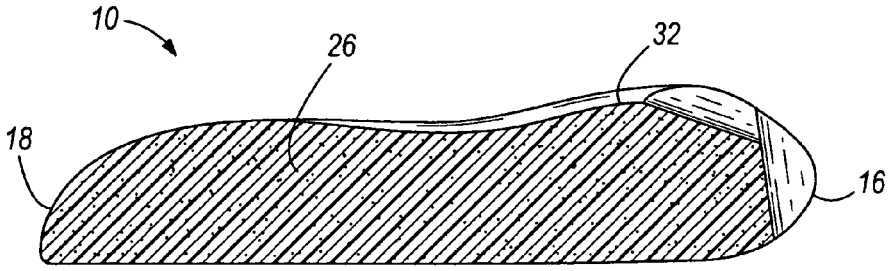
FIG. 9 is a cross-sectional view of the pillow illustrated in FIGS. 1–8, taken along lines 9—9 of FIG. 2.
Figure 10:
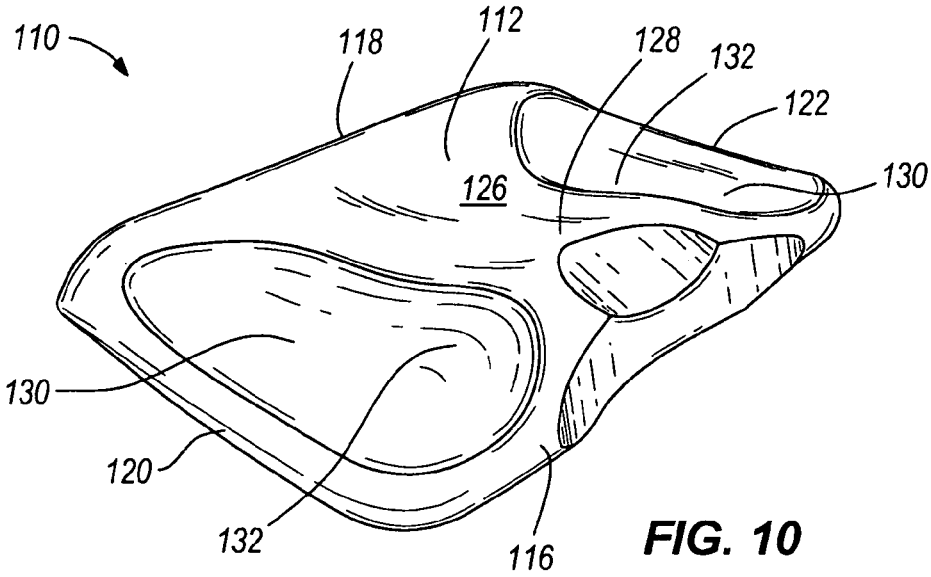
FIG. 10 is a front perspective view of a pillow according to another embodiment of the present invention.
Figure 11:
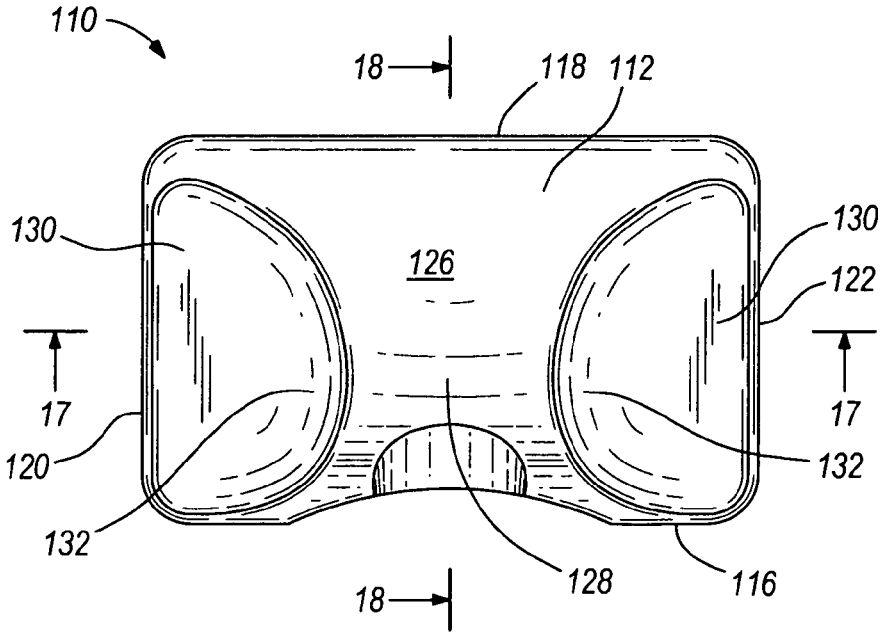
FIG. 11 is a top plan view of the pillow illustrated in FIG. 10.
Figure 12:
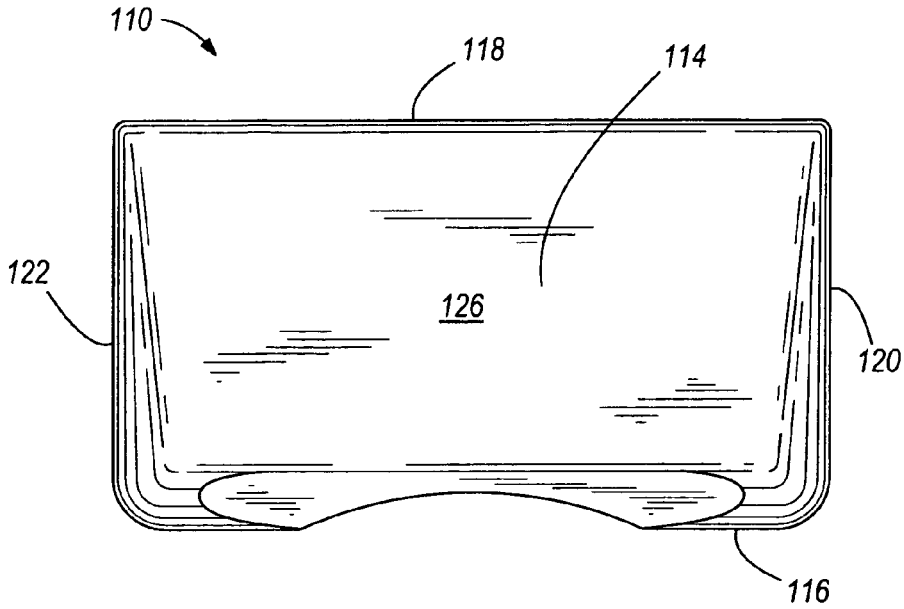
FIG. 12 is a bottom plan view of the pillow illustrated in FIGS. 10 and 11.
Figure 13:
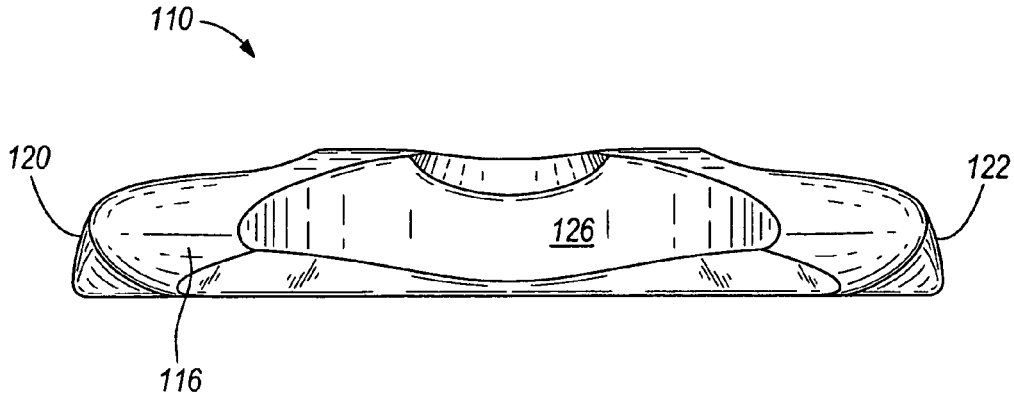
FIG. 13 is a front elevational view of the pillow illustrated in FIGS. 10–12.
Figure 14:
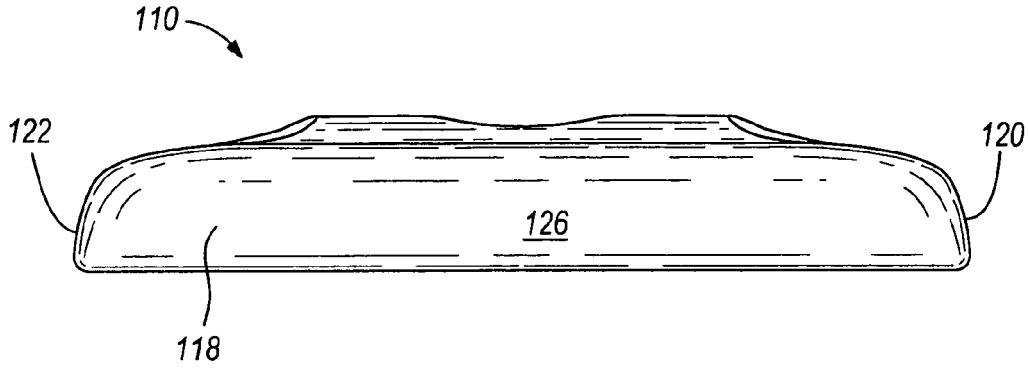
FIG. 14 is a rear elevational view of the pillow illustrated in FIGS. 10–13.
Figure 15:
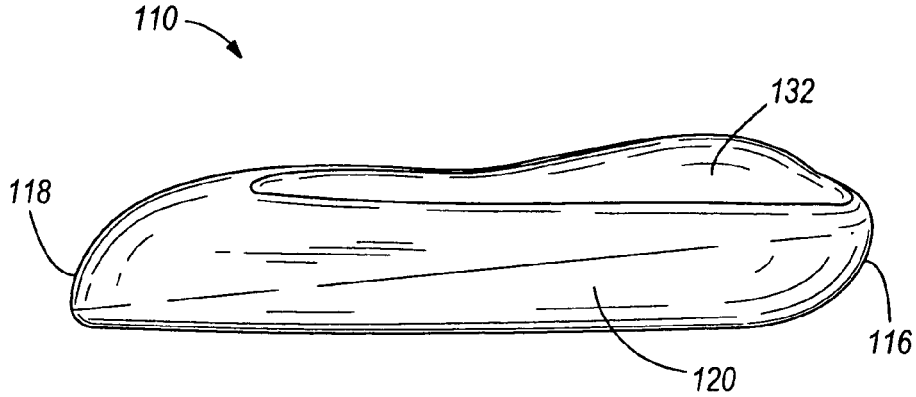
FIG. 15 is a left elevational view of the pillow illustrated in FIGS. 10–14.
Figure 16:
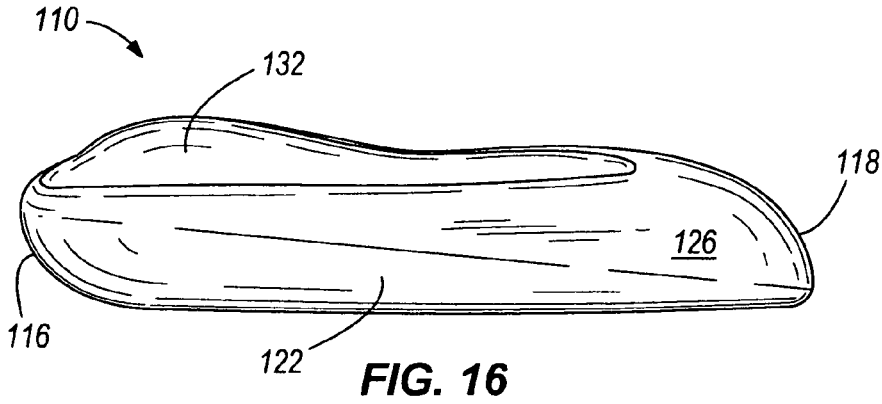
FIG. 16 is a right elevational view of the pillow illustrated in FIGS. 10–15.
Figure 17:
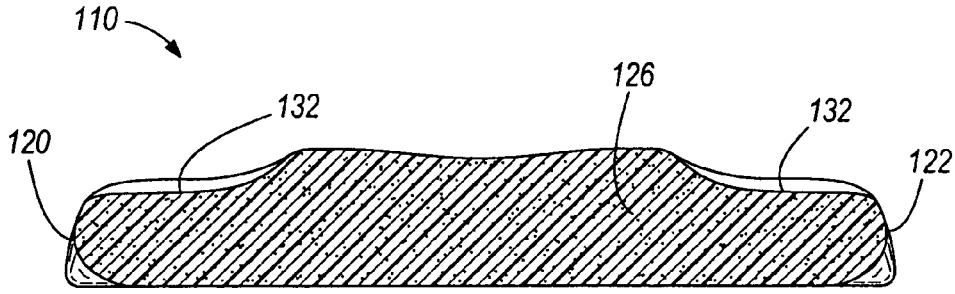
FIG. 17 is a cross-sectional view of the pillow illustrated in FIGS. 10–16, taken along lines 17—17 of FIG. 11.
Figure 18:
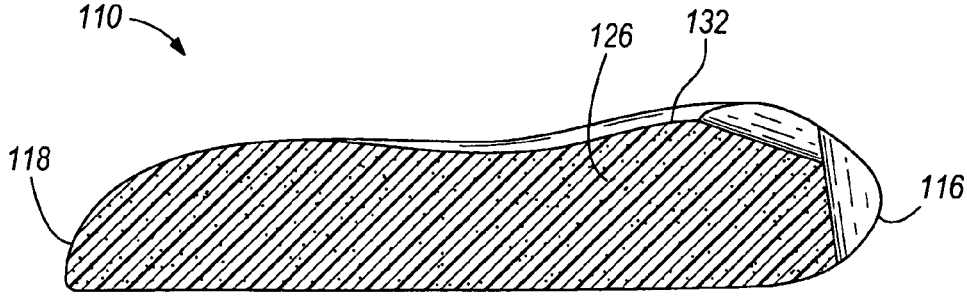
FIG. 18 is a cross-sectional view of the pillow illustrated in FIGS. 10–17, taken along lines 18—18 of FIG. 11.

With reference to FIG. 8, a cross-sectional shape of the body 26 taken by a plane bisecting the body 26 in a lateral direction can have a central plateau or other elevated surface 34 flanked by concave shapes of the adjacent recesses 32. The ends of either or both concave shapes can be at the same or different elevations (e.g., an end of each concave shape proximate the center portion 28 having a higher elevation than the end of each concave shape proximate each respective lateral side 20, 22 of the pillow 10 in the illustrated embodiment of FIGS. 1–9).

A cross-sectional shape of the body 26 taken by a plane passing through a center of either recess 32 in a forward/rearward direction can have a concave shape. The ends of this concave shape can be at the same or different elevations (e.g., an end of the concave shape proximate the rear side 18 of the pillow 10 having a higher elevation than the end of the concave shape proximate the front side 16 of the pillow 10 in the illustrated embodiment of FIGS. 1–9).

As best shown in FIG. 8, the body 26 can be downwardly sloped in opposite directions from the center portion 28 of the body 26. The slope in either or both directions can be greater than about 0 degrees and/or less than about 50 degrees (measured by a straight object lying upon the center portion 28 mid-way between the front and rear sides 16, 18 of the pillow 10 and extending laterally to a respective side 20, 22 of the pillow 10). In other embodiments, this slope is greater than about 10 degrees and/or less than about 40 degrees. In the illustrated embodiment of FIGS. 1–9, this slope is about 10 degrees.

In some embodiments, either or both recesses 32 are at least partially open to the adjacent lateral side 20, 22 and/or to the front side 16 of the pillow 10. For example, the recesses 32 in the embodiment of FIGS. 1–9 extend to and are open to the lateral sides 20, 22 and the front side 16 of the pillow 10. Such recess shapes can increase user comfort in some positions of the user on the pillow 10, such as a user resting his or her head within either recess 32 while facing either lateral direction. Also, such recess shapes can promote airflow toward and away from a user across the top side 12 of the pillow 10. In some embodiments, either or both recesses 32 can also or instead extend to and be open to the rear side 18 of the pillow 10.

Figure 2:
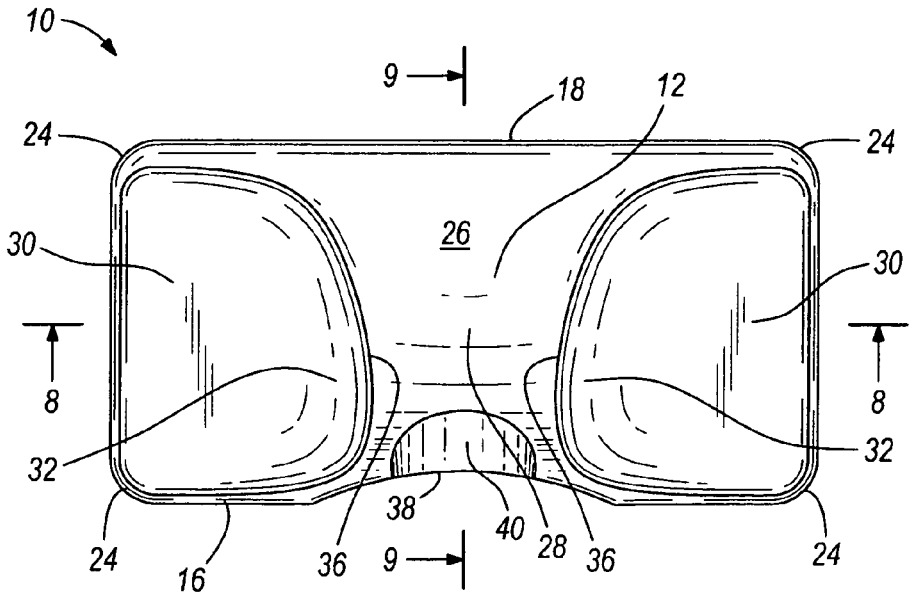
FIG. 2 is a top plan view of the pillow illustrated in FIG. 1.
Figure 3:
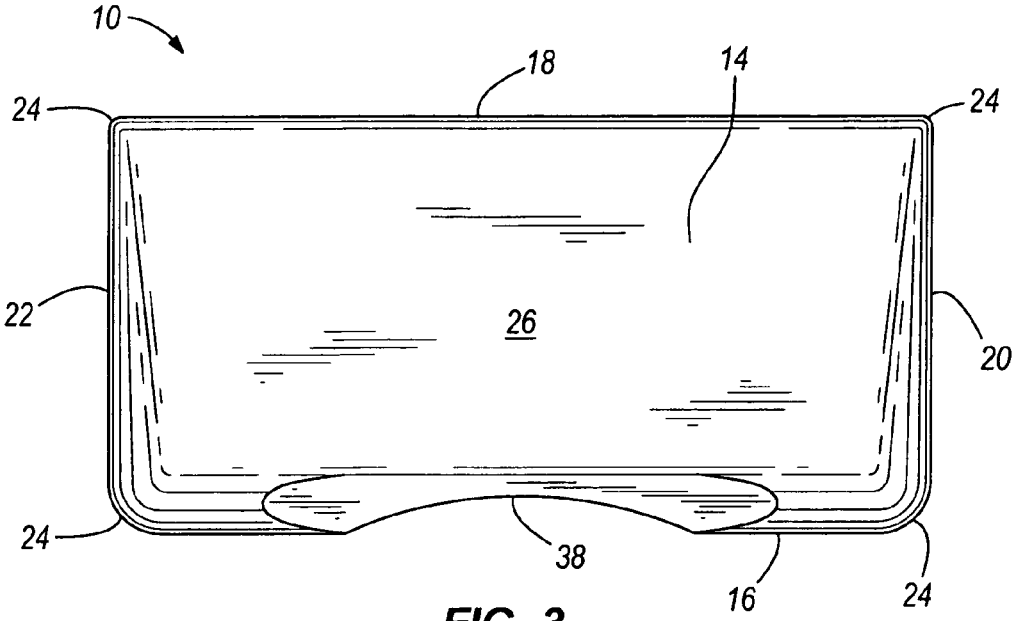
FIG. 3 is a bottom plan view of the pillow illustrated in FIGS. 1 and 2.
Figure 6:
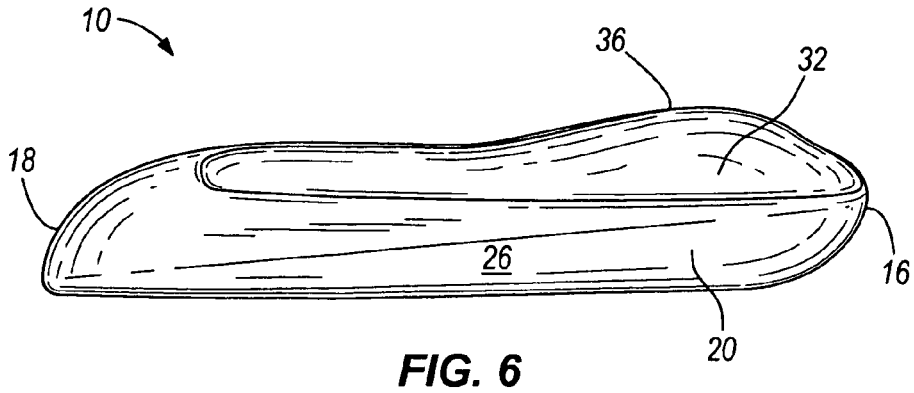
FIG. 6 is a left elevational view of the pillow illustrated in FIGS. 1–5.
Figure 4:
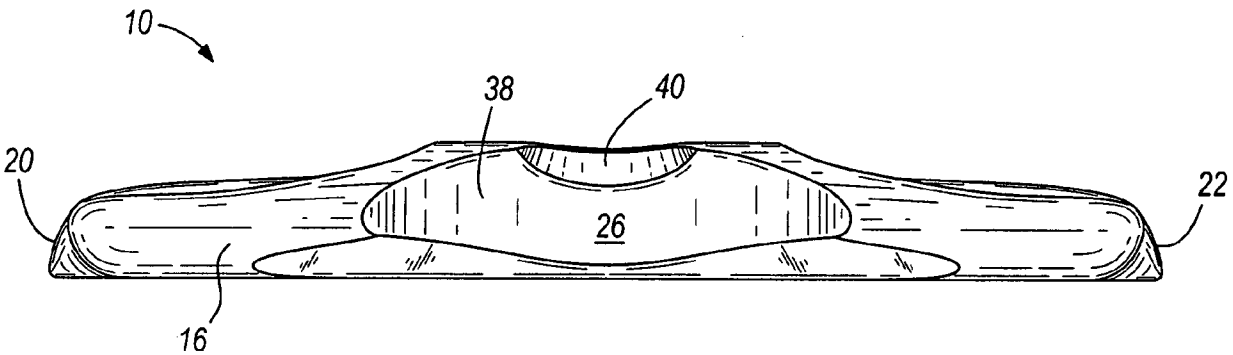
FIG. 4 is a front elevational view of the pillow illustrated in FIGS. 1–3.
Figure 5:
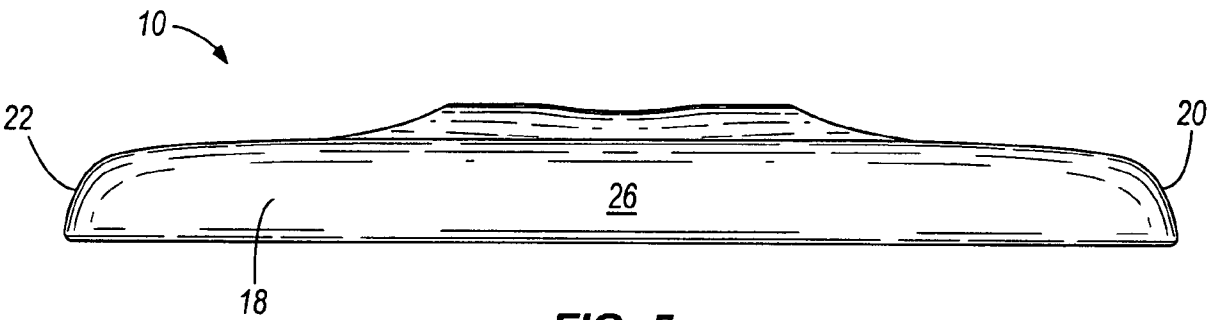
FIG. 5 is a rear elevational view of the pillow illustrated in FIGS. 1–4.
Figure 7:
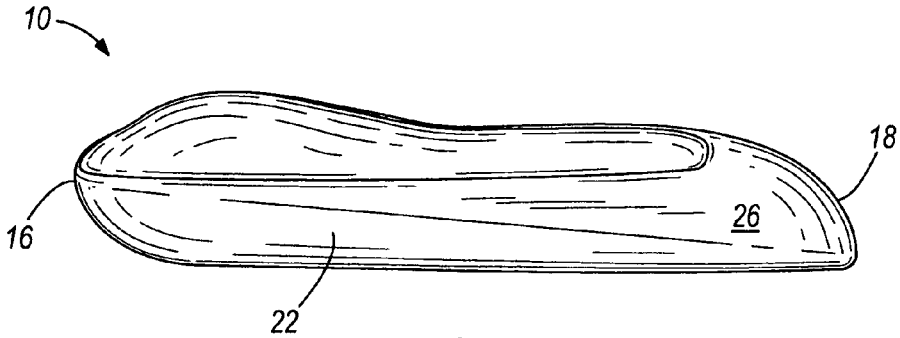
FIG. 7 is a right elevational view of the pillow illustrated in FIGS. 1–6.

With reference now to FIGS. 1 and 2, in some embodiments the recesses 32 are immediately adjacent the center portion 28 of the body 26. In such embodiments, a boundary 36 can be defined between the center portion 28 and each recess 32. The boundaries 36 can have any shape desired. In the illustrated embodiment of FIGS. 1–9, each boundary 36 is arcuate in shape, and presents a concave shape toward a respective recess 32. Such a boundary shape can define a center portion 28 providing sufficient support for the back of a user's head (when the user is lying on his or her back, front, or side), while still providing a recess shape desirable for a user's head lying within either recess 32. As used herein and in the appended claims, the term "arcuate" refers to any curved shape having a constant or non-constant radius.

The boundaries 36 can define transitions between the center portion 28 and the recesses 32 described above. However, in some embodiments the boundaries 36 are not sharp edges or breaks in the surface of the body 26. Instead, the boundaries 36 can be smooth and seamless transitions between the center portion 28 and the recesses 32, thereby reducing or eliminating facets on the surface of the body 26 defined by the recesses 32 and/or the center portion 28. Accordingly, the opportunity for lines and other blemishes to form upon a user's face can be reduced or eliminated. In some embodiments, the use of visco-elastic material can also significantly reduce or eliminate the opportunity for lines and other blemishes to form on the face of a user resting upon the pillow 10. In this regard, when a portion of a user's head exerts pressure upon a boundary 36, the visco-elastic material of the body 26 can conform to that portion of the user's head rather than exerting an in-kind counter-pressure that could otherwise cause a line or blemish. Therefore, in some embodiments, the body 26 can have boundaries that are more clearly defined or that have sharper angles without generating such results. However, used in combination with boundaries defining smooth transitions between the center portion 28 and the recesses 32, visco-elastic body material can provide superior performance results.

As described above, the pillow 10 can be used to support the head of a user resting upon a center portion 28 of the body 26. However, the pillow 10 can also be used to support the heads of two users. In particular, the head of a user can lie in each recess 32, wherein the users can face one another, away from one another, or in the same direction. The shape of the recesses illustrated in FIGS. 1–9 (i.e., concave lateral and forward/rearward recess shapes, recesses open to lateral sides 20, 22 and/or the front side 16 of the body 26, arcuate boundaries 36 between the center portion 28 and the recesses 32, and/or smooth boundary shapes) promote this manner in which the pillow 10 can be used by enabling free airflow for the users, sufficient support for the heads of both users, and sufficient space between the users' heads.

With reference to FIGS. 1–4, in some embodiments the pillow 10 can have a recess 38 located in the front side 16 of the pillow 10. In some embodiments, the recess 38 is substantially centrally located on the front side 16 of the pillow 10. However, in other embodiments, the recess 38 can be off-center with respect to the front side 16 of the pillow 10 (such as, for example, when two recesses 38 are located in the front side 16 of the pillow 10 to accommodate the shoulders of two users). With reference again to FIGS. 1–4, the recess 38 can extend alongside any part of the center portion 28, and in some embodiments extends alongside the entire center portion 28. The recess 38 can be shaped to receive at least part of a shoulder of a user lying on his or her side and/or at least part of both shoulders of a user lying on his or her back or front. In some embodiments, the recess 38 is generally arcuate in shape for this purpose, although the recess 38 can have any other shape desired.

As also shown in FIGS. 1–4, the pillow 10 can also or instead have a recess 40 located in the center portion 28 of the body 26 proximate the front side 16 of the pillow 10. In some embodiments, the recess 40 is substantially centrally located on the front side 16 of the pillow 10. However, in other embodiments, this recess 40 can be off-center with respect to the front side 16 of the pillow 10 (such as, for example, when two recesses 40 are located in the front side 16 of the pillow 10 to accommodate the shoulders of two users). With reference again to FIGS. 1–4, the recess 40 can be shaped to receive at least part of the neck of a user lying on his or her side, back, or front. In some embodiments, the recess 40 is generally arcuate in shape for this purpose, although the recess 40 can have any other shape desired.

In some embodiments, the pillow 10 can have a cover (not shown). The cover can be a suitably-sized pillowcase, or can be shaped to at least partially correspond to the shape of the pillow 10. The cover can partially or fully enclose the body 26, and can comprise many different types of materials, including without limitation nylon, polyester, and other types of plastic, natural or synthetic rubber, cotton, wool, and any blend or other combination thereof. Still other types of cover materials are possible, and fall within the spirit and scope of the present invention. Also, the cover can be vapor and/or liquid permeable or non-permeable, can be in any woven or non-woven form, can be coated with any material desired, and can comprise portions having different properties connected together by stitching or in any other suitable manner.

Another embodiment of a pillow according to the present invention is illustrated in FIGS. 10–18, and is indicated generally at 110. Like the pillow 10 illustrated in FIGS. 1–9 and described above, the pillow 110 illustrated in FIGS. 10–18 has a top side 112 upon which a user's head can rest, a bottom side 114 substantially facing a support surface upon which the pillow 110 can rest, a front side 116 substantially facing the body of a user whose head is upon the pillow 110, a rear side 118 opposite the front side 116, lateral sides 120, 122 on opposite ends of the pillow 110, and a body 126 with a center portion 128 flanked by side portions 130 having respective recesses 132. However, the pillow 110 illustrated in FIGS. 10–18 is smaller than that illustrated in FIGS. 1–9, is comparable in size to a standard size pillow, and is presented as an example of how any or all of the features and structure described above with reference to the queen-size pillow 10 of FIGS. 1–9 can be applied to pillows having other sizes. Reference should be made to the above description for additional information regarding the structure and features, and possible alternatives to the structure and features of the pillow 110 illustrated in FIGS. 9–18.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A pillow for supporting a user's head, the pillow comprising:

a body of visco-elastic material comprising:

a width;

a length greater than the width;

a bottom side;

a top side comprising first and second portions on opposite ends of the length of the pillow, wherein the first and second portions of the top side are separated by a center portion; and a recess in each of the first and second portions of the top side, each recess comprising a first cross-sectional shape in a direction along the length of the body and a second cross-sectional shape in a direction along the width of the body and perpendicular to the first cross-sectional shape, wherein each of the first and second cross-sectional shapes are substantially smooth and unfaceted and substantially concave with respect to the top side, wherein the center portion defines a plateau between each recess, the plateau adapted to support the user's head.

2. The pillow as claimed in claim 1, wherein the visco-elastic material of the body has a density of no less than about 40 kg/m3 and no greater than about 110 kg/m3, and has a hardness of no less than about 30 N and no greater than about 80 N.

3. The pillow as claimed in claim 1, wherein the visco-elastic material of the body has a density of no less than about 50 kg/m3 and no greater than about 90 kg/m3, and has a hardness of no less than about 35 N and no greater than about 75 N.

4. The pillow as claimed in claim 1, wherein the body is defined by a single integral piece of visco-elastic foam.

5. The pillow as claimed in claim 1, wherein a majority of the width of the body at the center portion is sloped in a direction of the width.

6. The pillow as claimed in claim 1, wherein the center portion is separated from each recess by a respective arcuate boundary.

7. The pillow as claimed in claim 1, wherein:

the width of the body is defined between front and rear edges of the body; and the front edge of the body has an arcuate recess shaped to receive at least part of a shoulder of a user.

8. The pillow as claimed in claim 1, wherein:

the width of the body is defined between front and rear edges of the body; and the center portion comprises a recess proximate the front edge of the body and shaped to receive at least part of a neck of a user.

9. A pillow for supporting a head of a user, the pillow comprising:

a visco-elastic center portion elevated to support the head of the user;

first and second laterally-disposed visco-elastic portions on opposite sides of the visco-elastic center portion, the first and second visco-elastic portions both recessed with respect to the visco-elastic center portion;

a first plane passing through the visco-elastic center portion and substantially bisecting the pillow into substantially symmetrical lateral halves; and a second plane substantially perpendicular to the first plane and bisecting the pillow into asymmetrical front and rear halves;

wherein a cross-sectional shape of the pillow generated by the second plane comprises a central plateau flanked by concave arcuate recesses extending toward opposite lateral sides of the pillow.

10. The pillow as claimed in claim 9, wherein the visco-elastic center portion and the first and second visco-elastic portions each comprise visco-elastic foam having a density of no less than about 40 kg/m3 and no greater than about 110 kg/m3, and having a hardness of no less than about 30 N and no greater than about 80 N.

11. The pillow as claimed in claim 9, wherein the visco-elastic center portion and the first and second visco-elastic portions each comprise visco-elastic foam having a density of no less than about 50 kg/m3 and no greater than about 90 kg/m3, and having a hardness of no less than about 35 N and no greater than about 75 N.

12. The pillow as claimed in claim 9, wherein the pillow comprises a single integral piece of visco-elastic foam defining the visco-elastic center portion and the first and second visco-elastic portions.

13. The pillow as claimed in claim 9, wherein a majority of the cross-sectional shape of the pillow defined by the first plane is sloped downward toward a single edge of the pillow.

14. The pillow as claimed in claim 9, wherein the visco-elastic center portion meets each of the first and second visco-elastic portions along a respective arcuate boundary.

15. The pillow as claimed in claim 9, wherein the front half of the pillow comprises a front edge comprising an arcuate recess shaped to receive at least part of a shoulder of the user.

16. The pillow as claimed in claim 9, wherein the center portion comprises a recess shaped to receive at least part of a neck of a user.

17. A pillow for supporting a user's head having a back and a cheek, the pillow comprising:

a visco-elastic body comprising a periphery;

a center portion; and first and second bowl-shaped recesses on opposite lateral sides of the center portion, each of the first and second bowl-shaped recesses having an upwardly-facing concave bottom, each of the first and second bowl-shaped recesses at least partially open to the periphery of the visco-elastic body.

18. The pillow as claimed in claim 17, wherein the visco-elastic body has a density of no less than about 40 kg/m3 and no greater than about 110 kg/m3, and has a hardness of no less than about 30 N and no greater than about 80 N.

19. The pillow as claimed in claim 17, wherein the visco-elastic body has a density of no less than about 50 kg/m3 and no greater than about 90 kg/m3, and has a hardness of no less than about 35 N and no greater than about 75 N.

20. The pillow as claimed in claim 17, wherein the visco-elastic body is defined by a single integral piece of visco-elastic foam.

21. The pillow as claimed in claim 17, further comprising:

front and rear edges between which the center portion and the first and second bowl-shaped recesses are located; and a width defined by and between the front and rear edges;

wherein a majority of the center portion is downwardly-sloped toward the rear edge of the pillow.

22. The pillow as claimed in claim 17, wherein the center portion is separated from each bowl-shaped recess by a respective arcuate boundary.

23. The pillow as claimed in claim 17, wherein:

the visco-elastic body further comprises front and rear edges between which the center portion and the first and second bowl-shaped recesses are located; and the front edge of the visco-elastic body comprises an arcuate recess shaped to receive at least part of a shoulder of the user.

24. The pillow as claimed in claim 17, wherein:

the visco-elastic body further comprises front and rear edges between which the center portion and the first and second bowl-shaped recesses are located; and the center portion comprises a recess proximate the front edge of the visco-elastic body and shaped to receive at least part of a neck of a user.

* * * * *